US011396351B2

(12) United States Patent
Hong et al.

(10) Patent No.: US 11,396,351 B2
(45) Date of Patent: Jul. 26, 2022

(54) PLATFORM FOR FLOATING TYPE OFFSHORE STRUCTURE HAVING PROTRUSION MEMBER AND SEMI-SUBMERSIBLE OFFSHORE STRUCTURE INCLUDING THE SAME

(71) Applicants: Korea Institute of Ocean Science & Technology, Ansan-si (KR); VL Offshore, LLC, Houston, TX (US)

(72) Inventors: Key Yong Hong, Daejeon (KR); Kang Su Lee, Incheon (KR); Kyong Hwan Kim, Daejeon (KR); Jong Su Choi, Daejeon (KR); Se Wan Park, Daejeon (KR); Sung Youn Boo, Cypress, TX (US); Steffen A. Shelley, Houston, TX (US); Dae Jun Kim, Houston, TX (US)

(73) Assignees: Korea Institute of Ocean Science & Technology, Ansan-si (KR); VL OFFSHORE, LLC, Houston, TX (US)

( * ) Notice: Subject to any disclaimer, the term of this patent is extended or adjusted under 35 U.S.C. 154(b) by 926 days.

(21) Appl. No.: 16/301,396

(22) PCT Filed: Aug. 12, 2016

(86) PCT No.: PCT/KR2016/008879

§ 371 (c)(1),
(2) Date: Nov. 13, 2018

(87) PCT Pub. No.: WO2017/195937

PCT Pub. Date: Nov. 16, 2017

(65) Prior Publication Data

US 2020/0317309 A1 Oct. 8, 2020

(30) Foreign Application Priority Data

May 13, 2016 (KR) ..... KR10-2016-0058999

(51) Int. Cl.
*B63B 39/10* (2006.01)
*B63B 21/50* (2006.01)
(Continued)

(52) U.S. Cl.
CPC ..... *B63B 39/10* (2013.01); *B63B 21/50* (2013.01); *B63B 35/34* (2013.01); *B63B 35/44* (2013.01);
(Continued)

(58) Field of Classification Search
CPC ..... B63B 39/10; B63B 21/50; B63B 35/34; B63B 35/44; B63B 43/04; B63B 2035/446; B63B 2209/20; B63B 2221/00
See application file for complete search history.

(56) References Cited

U.S. PATENT DOCUMENTS 3,246,476 A * 4/1966 Wolff ..... E02B 17/027 405/207
6,447,208 B1 * 9/2002 Huang ..... B63B 21/502 405/224

FOREIGN PATENT DOCUMENTS

JP 2008-013101 A 1/2008
KR 10-2010-0090991 A 8/2010
(Continued)

*Primary Examiner* — Stephen P Avila
(74) *Attorney, Agent, or Firm* — Novick, Kim & Lee, PLLC; Sang Ho Lee; Hyun Woo Shin

(57) ABSTRACT

A platform for a semi-submersible floating type offshore structure according to an exemplary embodiment of the present invention includes a main body which is installed on the sea and has an arrangement structure in which a plurality of pontoons is combined to form a plurality of polygonal shapes; and a protrusion member connecting unit which extends from each corner of the main body and connects a protrusion member outwardly protruding from the main body to the main body.

18 Claims, 9 Drawing Sheets

(51) Int. Cl.
*B63B 35/34* (2006.01)
*B63B 35/44* (2006.01)
*B63B 43/04* (2006.01)

(52) U.S. Cl.
CPC ..... *B63B 43/04* (2013.01); *B63B 2035/446* (2013.01); *B63B 2209/20* (2013.01); *B63B 2221/00* (2013.01)

(56) References Cited

FOREIGN PATENT DOCUMENTS

| | | | |
|---|---|---|---|
| KR | 10-2011-0015418 | A | 2/2011 |
| KR | 10-2011-0120608 | A | 11/2011 |
| KR | 10-2015-0012437 | A | 2/2015 |
| KR | 10-1521163 | B1 | 5/2015 |

* cited by examiner

PLATFORM FOR FLOATING TYPE OFFSHORE STRUCTURE HAVING PROTRUSION MEMBER AND SEMI-SUBMERSIBLE OFFSHORE STRUCTURE INCLUDING THE SAME

TECHNICAL FIELD

Exemplary embodiments of the present invention relate to a platform for a floating type offshore structure having a protrusion member which minimizes influence by a seawater flow to improve stability at sea and a semi-submersible offshore structure including the same.

BACKGROUND ART

Generally, a semi-submersible offshore structure, such as a hybrid power-generation structure on the sea is equipped with an expensive drilling system or riser equipment for perforation on an upper deck and floats on the sea and moored at a fixed position to be used.

For example, in the case of a semi-submersible offshore structure such as a drilling rig ship, various devices extend from the upper deck of the drilling rig ship to a sea floor during the drilling operation so that the devices may be significantly affected by an up and down movement of the drilling rig ship.

That is, the semi-submersible offshore structure is used while floating on the sea so that movement is inevitably caused by the flow of the seawater.

When the offshore structure consistently moves due to the flow of the seawater such as wave, it greatly affects the performance of various drilling devices installed in the offshore structure and moreover, drilling devices may be damaged.

As a prior art document, there is Korean Unexamined Patent Application Publication No. 10-2010-0090991 (published on Aug. 18, 2010).

DISCLOSURE

Technical Problem

An exemplary embodiment of the present invention provides a platform for an offshore structure having a protrusion member which minimizes influence by flow of seawater to stably moor the offshore structure with improved stability on the sea and a semi-submersible offshore structure including the same.

Technical problems to be solved by the present invention are not limited to the above-mentioned technical problem(s), and other technical problem(s), which is (are) not mentioned above, can be clearly understood by those skilled in the art from the following descriptions.

Technical Solution

A platform for a floating type offshore structure having a protrusion member according to an exemplary embodiment of the present invention includes: a main body which is installed on the sea and has an arrangement structure in which a plurality of pontoons is combined to form a plurality of polygonal shapes, a protrusion member which extends from each corner of the main body and outwardly protrudes from the main body, and a protrusion member connecting unit which connects the protrusion member to the main body.

The platform for a floating type offshore structure may further include a protrusion member on which a tower is installed and the protrusion member is located at an end of the protrusion member connecting unit.

The tower may be a wind tower for wind power generation.

A mooring line fastening unit for connecting a mooring line may be installed at a side pontoon of the main body.

The mooring line fastening units may be installed on both sides of the corner.

The mooring line fastening units may be disposed to be symmetrical to each other with respect to a length direction of the protrusion member connecting unit.

The main body may include an upper horizontal connecting unit and a lower horizontal connecting unit which have an arrangement structure in which a plurality of pontoons is coupled in a horizontal direction and spaced apart from each other to be parallel and a vertical connecting unit which is disposed between the upper horizontal connecting unit and the lower horizontal connecting unit to be perpendicular thereto.

The platform for a floating type offshore structure may further include a protrusion member reinforcing unit which connects the side pontoon of the main body and the protrusion member and extends from the vertical connecting unit of the main body to be inclined.

The protrusion member reinforcing unit may be formed to be downwardly inclined from an upper portion of the vertical connecting unit of the main body.

The protrusion member reinforcing unit may be formed to be upwardly inclined from a lower portion of the vertical connecting unit of the main body.

The protrusion member reinforcing unit may include a first protrusion member reinforcing unit which is formed to be downwardly inclined from an upper portion of the vertical connecting unit of the main body; and a second protrusion member reinforcing unit which is formed to be upwardly inclined from a lower portion of the vertical connecting unit of the main body. A semi-submersible offshore structure according to an exemplary embodiment of the present invention includes the above-described platform for a floating type offshore structure. Specific items of other embodiments are included in the detailed description and the drawings.

Advantageous Effects

According to an exemplary embodiment of the present invention, a protrusion member connecting unit is formed to outwardly protrude from a main body so that an external force caused by waves while being moored on the sea may be dispersed and the influence by the wake may be reduced.

According to an exemplary embodiment of the present invention, unlike a platform for a floating type offshore structure of the related art, a reach distance limit of a crane for installing a structure is reduced and thus accessibility and operability of the crane may be greatly improved. According to an exemplary embodiment of the present invention, the semi-submersible offshore structure stably floats by a mooring line which is connected to a mooring line fastening unit and the mooring line fastening unit is installed at a corner of the main body so that the influence of the load of a mooring line which is applied to a connecting member of the protruding unit and the main body is reduced, thereby structurally stabilizing the connecting member. According to an exemplary embodiment of the present invention, a protrusion member reinforcing unit is installed to disperse the load generated from the protrusion member so that the load which is concentrated on the protrusion member is dispersed to improve durability of the platform.

BEST MODE

Figure 1:
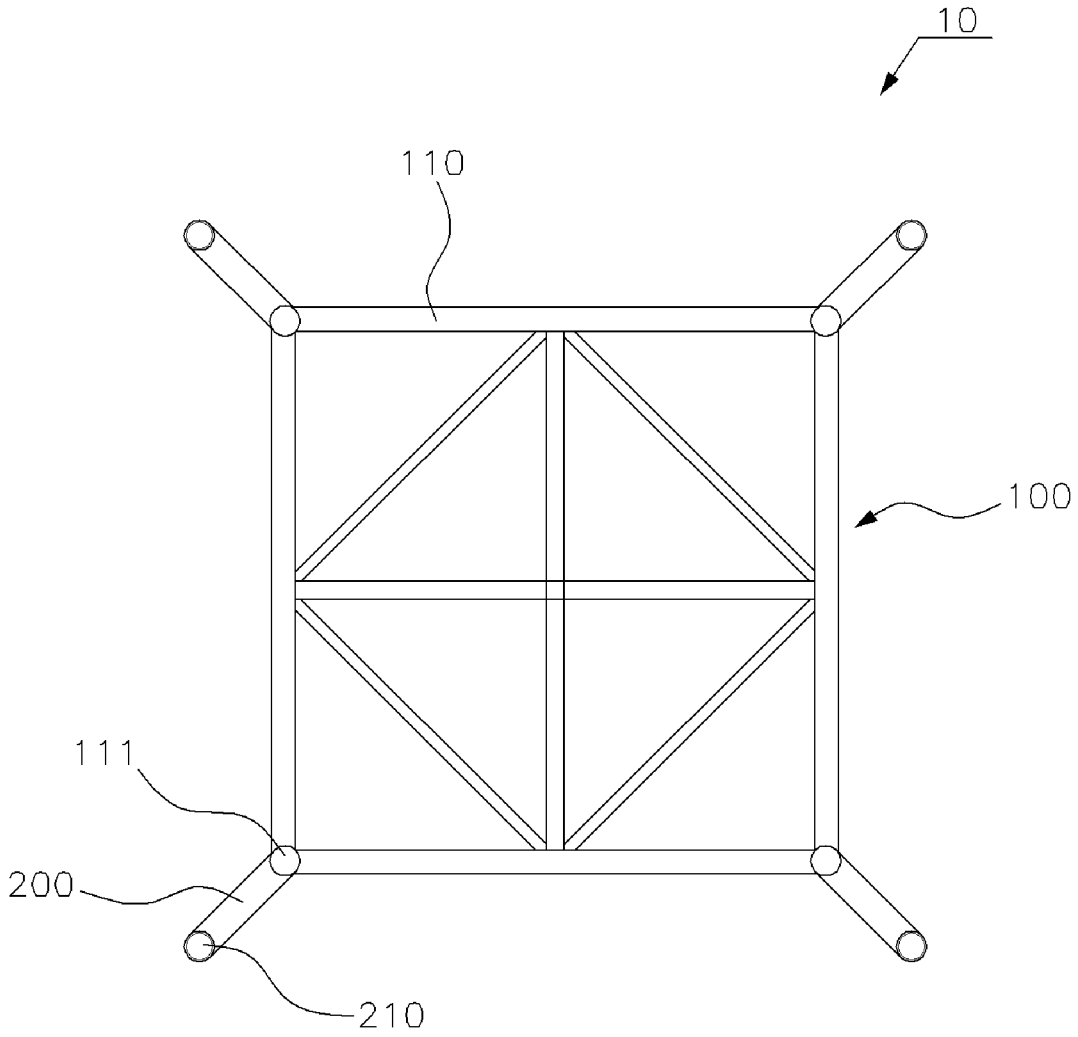
FIG. 1 is a front view of a platform for a floating type offshore structure according to an exemplary embodiment of the present invention.

Advantages and characteristics of the present invention and/or a method of achieving the advantages and characteristics will be clear by referring to exemplary embodiments described below in detail together with the accompanying drawings. However, the present invention is not limited to the following exemplary embodiments but may be implemented in various different forms. The exemplary embodiments are provided only to complete the disclosure of the present invention and to fully provide a person having ordinary skill in the art to which the present invention pertains with the category of the disclosure, and the present invention will be defined by the appended claims. Like reference numerals indicate like elements throughout the specification.

Hereinafter, exemplary embodiments of the present invention will be described in detail with reference to the accompanying drawings.

An offshore structure of the present invention is a semi-submersible offshore structure such as an oil and gas production facility or an offshore wind power generation facility, and is a facility which floats or is moored on the sea to produce oil or gas or perform hybrid power generation. FIG. 1 is a front view of a platform for a floating type offshore structure according to an exemplary embodiment of the present invention and FIG. 2 is a plan view of a platform for a floating type offshore structure according to another exemplary embodiment of the present invention.

Figure 2:
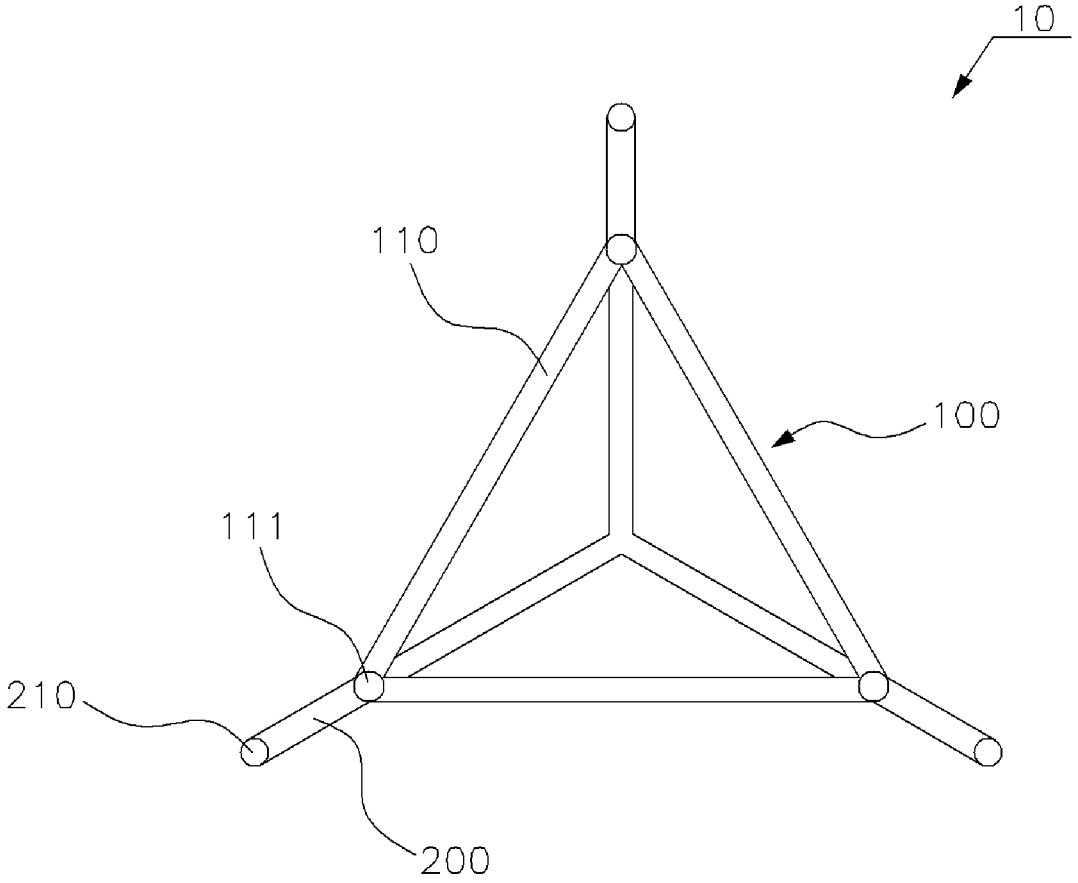
FIG. 2 is a plan view of a platform for a floating type offshore structure according to another exemplary embodiment of the present invention.

Referring to FIGS. 1 and 2, a floating type offshore structure according to an exemplary embodiment of the present invention has a platform for an offshore structure having a protrusion member 210 with an improved stability. The platform 10 for a floating type offshore structure includes a main body 100 and a protrusion member connecting unit 200.

The main body 100 is installed on the sea and has an arrangement structure in which a plurality of pontoons is combined to form a plurality of polygonal shapes.

For example, as illustrated in FIG. 1, the main body 100 may have an arrangement structure in which a side pontoon 110 forms a rectangular shape, a diamond-shaped pontoon is coupled inside the side pontoon 110, and a cross-shaped pontoon is coupled inside the diamond shape to divide the diamond shape into four parts.

As another example, as illustrated in FIG. 2, the main body 100 may have an arrangement structure in which a side pontoon 110 forms a triangular shape, a X-shaped pontoon is coupled inside the side pontoon 110 to divide the side pontoon into three parts.

As described above, the main body 100 may be formed by connecting a plurality of pontoons to disperse the load and improve the durability. In this case, the pontoons located at the outside of the main body 100 are connected so that the side pontoon 110 which determines a planar outer appearance of the main body 100 may have a polygonal shape and include a corner 111 which forms an angled portion of the polygon.

Even though in FIGS. 1 and 2, it is illustrated that the shapes formed by the side pontoon 110 of the main body 100 are a rectangle and a triangle, respectively, the shape of the main body is not limited thereto and the main body 100 may have an arrangement structure with various polygonal shapes.

The protrusion member connecting unit 200 extends from each corner 111 of the main body and connects the protrusion member 210 which outwardly protrudes from the main body 100 to the main body 100.

Specifically, since the protrusion member connecting unit 200 serves to connect the protrusion member 210 or a tower installed in the platform 10 for a floating type offshore structure to the main body 100, the protrusion member connecting unit may be a tower connecting unit and formed to outwardly protrude with respect to a center of the main body 100.

Even though the number of protrusion member connecting units 200 is not specifically limited, since the protrusion member connecting units are formed at all corners 111 of the main body 100, the number of protrusion member connecting units 200 may be desirably equal to the number of corners 111. Further, an extending direction of the protrusion member connecting unit 200, that is, a length direction or an extending length direction of the protrusion member connecting unit 200 may be more desirably located on the same line as the center of the main body 100.

In this case, since the protrusion member connecting unit 200 is formed to outwardly protrude from the main body 100, the platform 10 for a floating type offshore structure according to an exemplary embodiment of the present invention may disperse the external force by waves generated while being moored on the sea and reduce the influence of wakes.

That is, the protrusion member connecting unit 200 also serves as a sort of breakwater which protects the platform 10 for a floating type offshore structure according to the present invention from waves of the outside sea.

Further, the extending length of the protrusion member connecting unit 200 may be appropriately determined to be proportional to the size of the main body 100 equipped in the platform 10 for a floating type offshore structure.

The platform 10 for a floating type offshore structure according to an exemplary embodiment of the present invention may further include a protrusion member 210 for installing a tower and the protrusion member 210 is located at an end of the protrusion member connecting unit 200.

The tower may be a wind tower for wind power generation, but is not limited thereto and may include all structures which are installed in the existing offshore structure or can be installed in the existing offshore structure.

Figure 3:
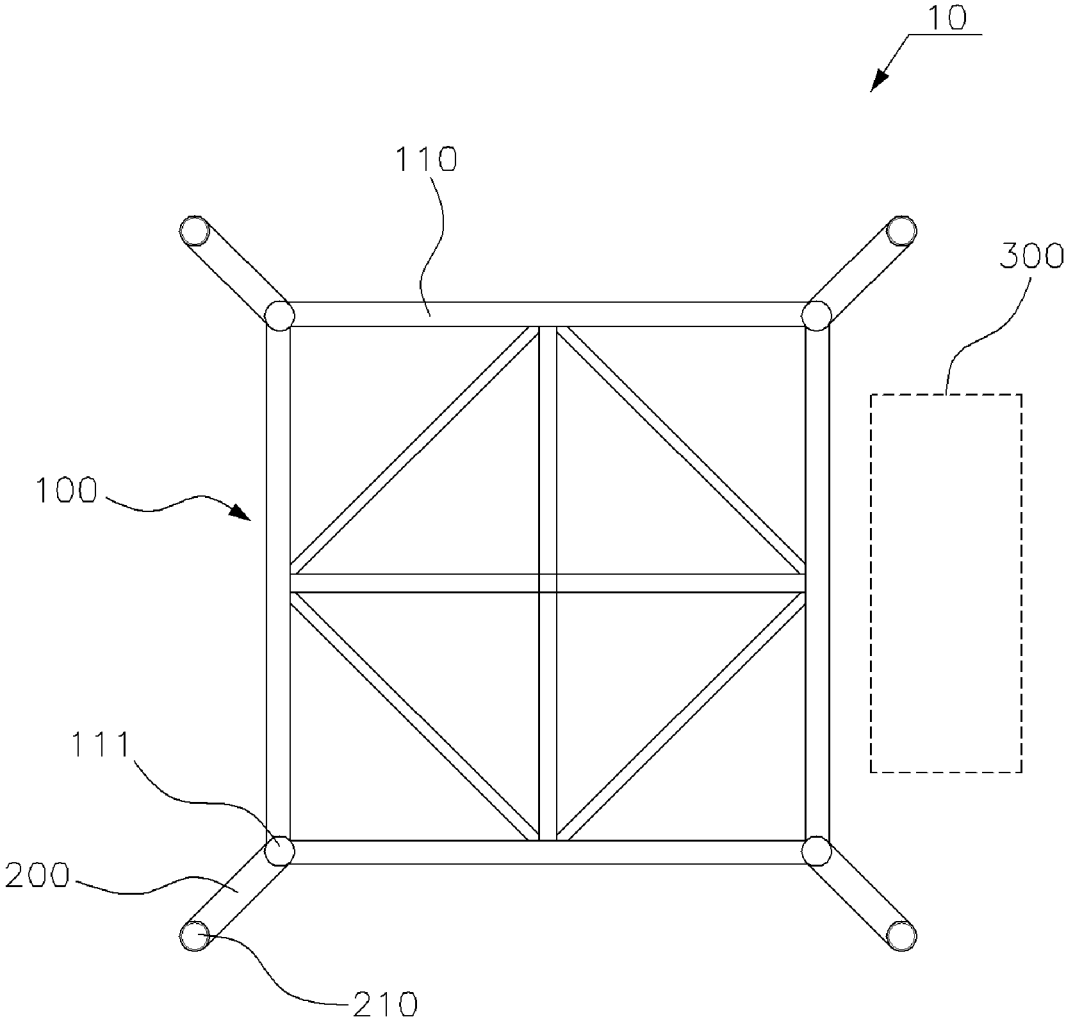
FIG. 3 is a view illustrating a crane which operates on a platform for a floating type offshore structure according to an exemplary embodiment of the present invention.
Figure 4:
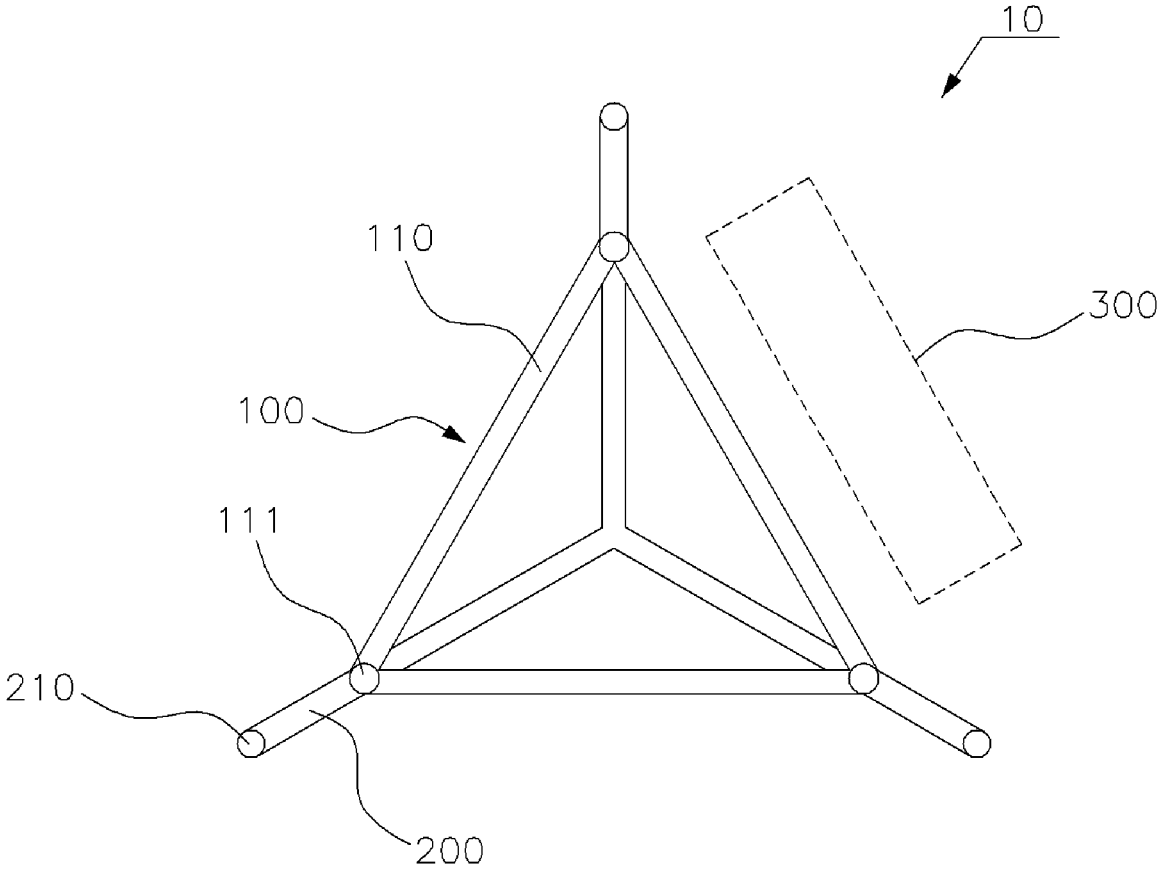
FIG. 4 is a view illustrating a crane which operates on a platform for a floating type offshore structure according to another exemplary embodiment of the present invention.

FIG. 3 is a view illustrating a crane which operates on a platform for a floating type offshore structure according to an exemplary embodiment of the present invention and FIG. 4 is a view illustrating a crane which operates on a platform for a floating type offshore structure according to another exemplary embodiment of the present invention.

In the existing platform for an offshore structure, an upper structure which mostly occupies the load is located inside the platform for an offshore structure, specifically, in a center portion, so that a crane having a long reach distance is required to install the structure.

Therefore, in the related art, there is a limitation of a size of the platform for a floating type offshore structure which can be manufactured in accordance with the realistic reach distance limit of the crane.

However, the protrusion member 210 according to the present invention is located at an end of the protrusion member connection unit 200 which is formed to outwardly protrude from the main body 100 so that unlike the platform for a floating type offshore structure of the related art, a reach distance limit of the crane 300 for installation of the structure is reduced, thereby greatly improving accessibility and operability of the crane 300.

In FIGS. 3 and 4, for the purpose of description, the size of the crane 300 is exaggerated, but actually the size of the platform for a floating type offshore structure is much larger than the crane 300. Therefore, the effect of improving the accessibility and the operability of the crane 300 due to the location of the protrusion member 210 may be more dramatic.

Figure 5:
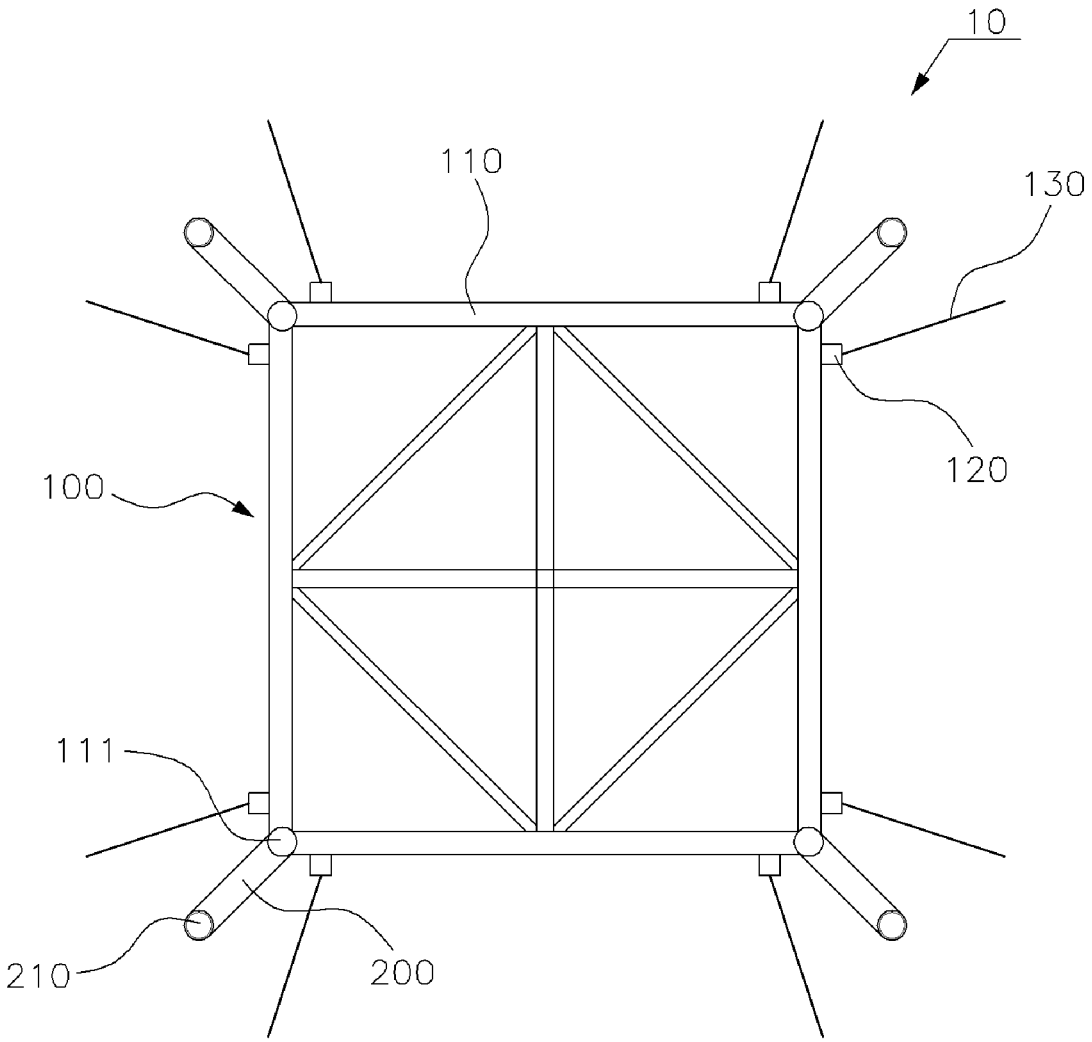
FIG. 5 is a plan view of a platform for a floating type offshore structure according to an exemplary embodiment of the present invention in which a mooring line fastening unit is installed.
Figure 6:
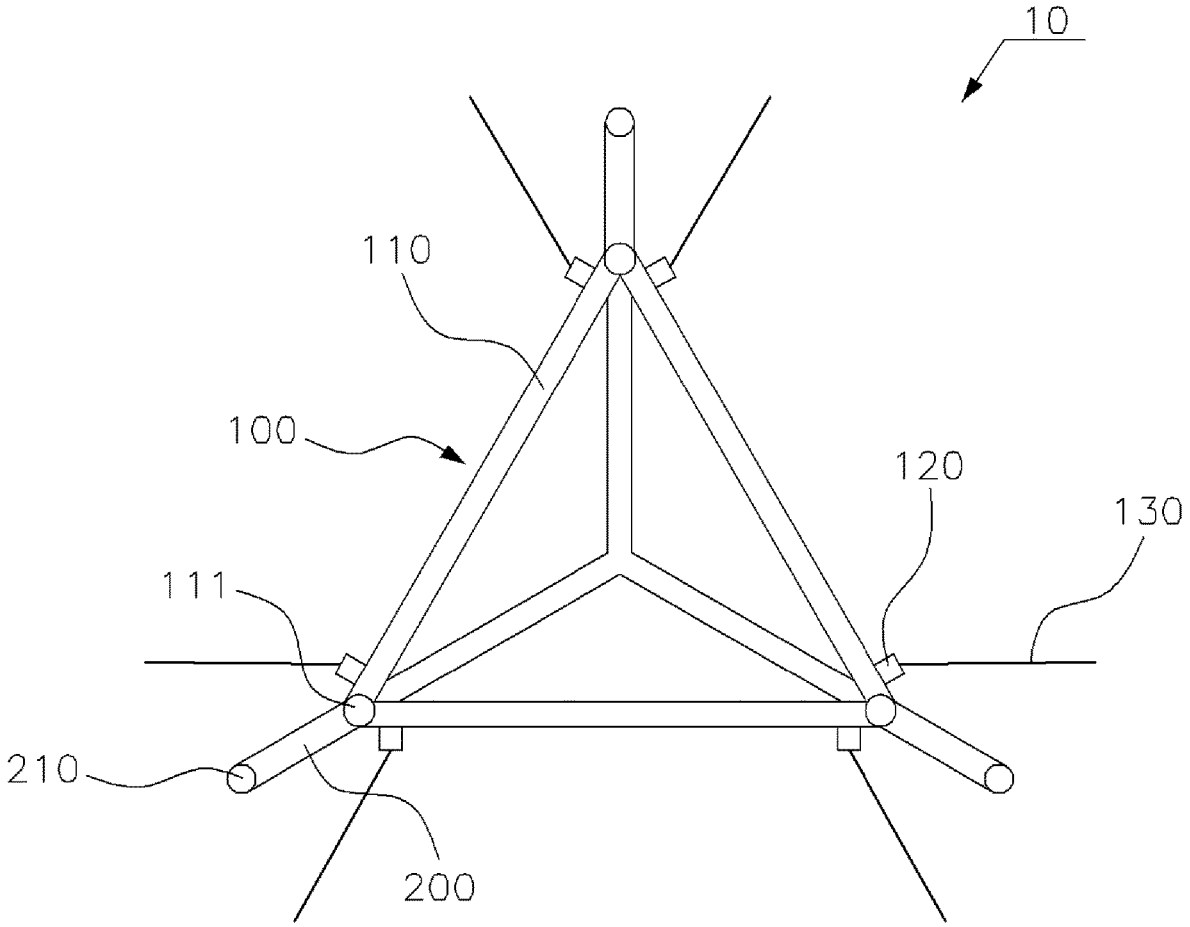
FIG. 6 is a plan view of a platform for a floating type offshore structure according to another exemplary embodiment of the present invention in which a mooring line fastening unit is installed.

FIG. 5 is a plan view of a platform for a floating type offshore structure according to an exemplary embodiment of the present invention in which a mooring line fastening unit is installed and FIG. 6 is a plan view of a platform for a floating type offshore structure according to another exemplary embodiment of the present invention in which a mooring line fastening unit is installed.

Referring to FIGS. 5 and 6, the side pontoon 110 of the main body 100 may be equipped with a mooring line fastening unit 120 to connect the mooring line 130.

Generally, a large load is applied to the mooring line fastening unit 120. However, in the platform 10 for a floating type offshore structure according to the present invention, the mooring line fastening unit 120 is installed not in the protrusion member connecting unit 200, but in the main body 100, specifically, at a corner of the main body 100 so that a structure stability of the protrusion member connecting unit 200 is significantly improved.

Specifically, the mooring line fastening units 120 may be installed to be adjacent to both sides of the corner 111 to which the protrusion member connecting unit 200 extends and a tower which mostly occupies the load is installed in the protrusion member connecting unit 200. The mooring line fastening units 120 are desirably disposed to be symmetrical with respect to a length direction of the protrusion member connecting unit 200 to disperse the force which is applied to the mooring line fastening unit 120.

By doing this, the platform 10 for a floating type offshore structure may stably float through the mooring line 130 connected to the mooring line fastening unit 120 and is installed at the corner of the main body so that the influence of the load of the mooring line which is applied to the connecting member of the protrusion member and the main body is reduced. Therefore, the connecting member has a stable structure.

Figure 7:
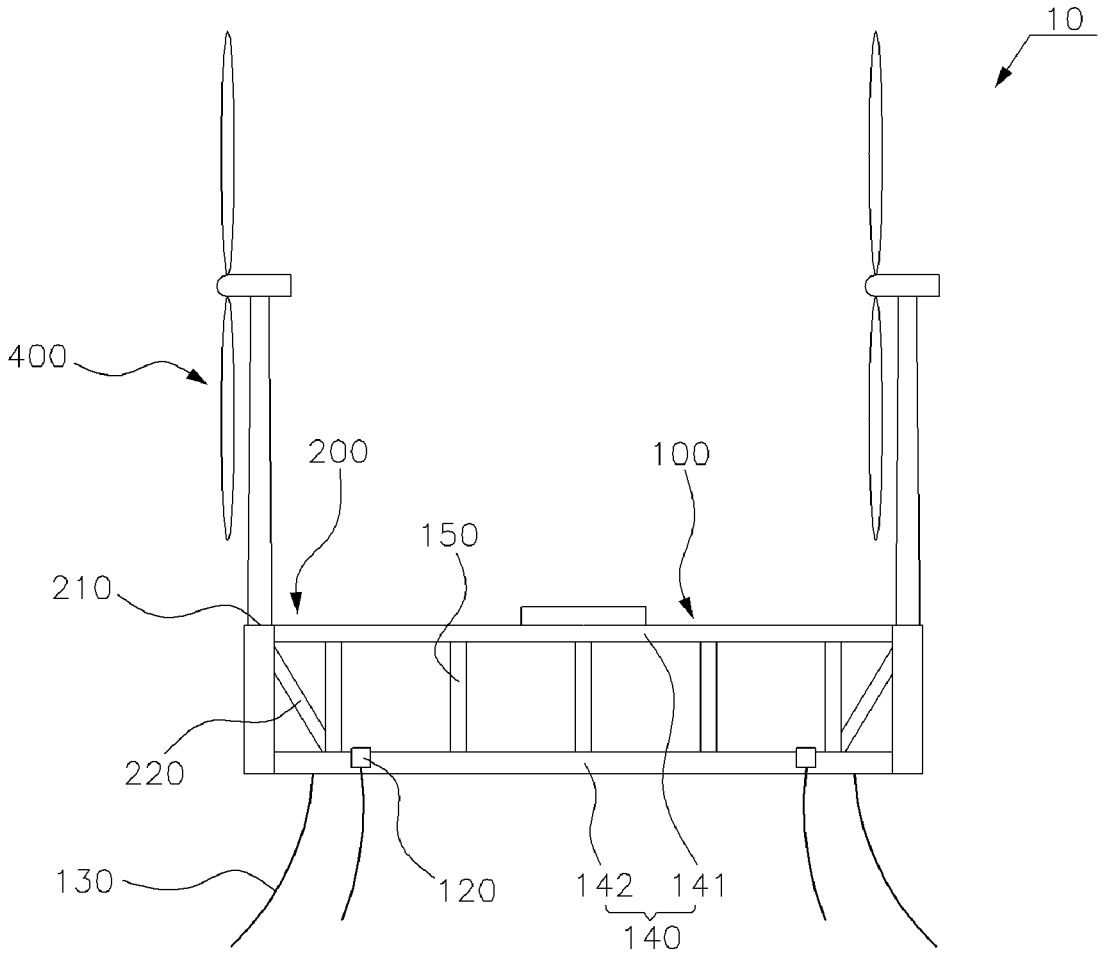
FIG. 7 is a front view of a platform for a floating type offshore structure according to an exemplary embodiment of the present invention.
Figure 8:
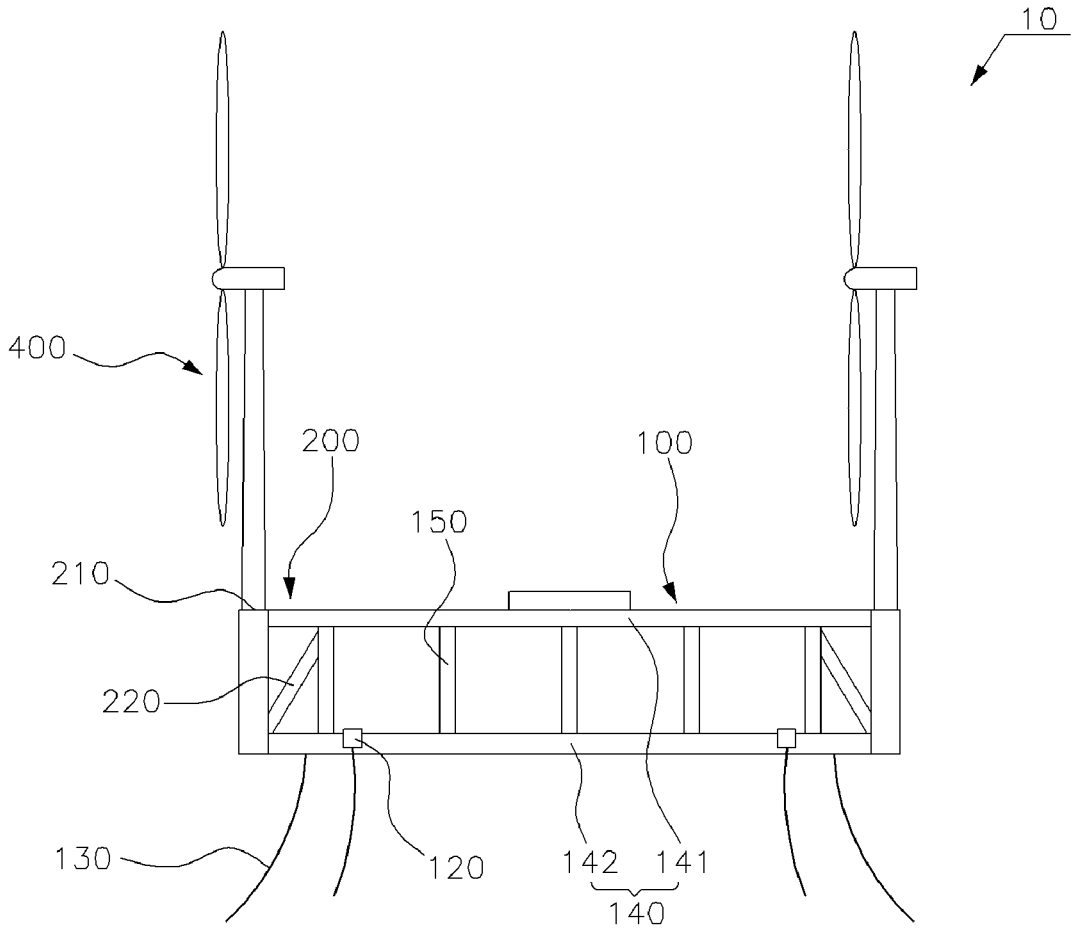
FIG. 8 is a front view of a platform for a floating type offshore structure according to another exemplary embodiment of the present invention.
Figure 9:
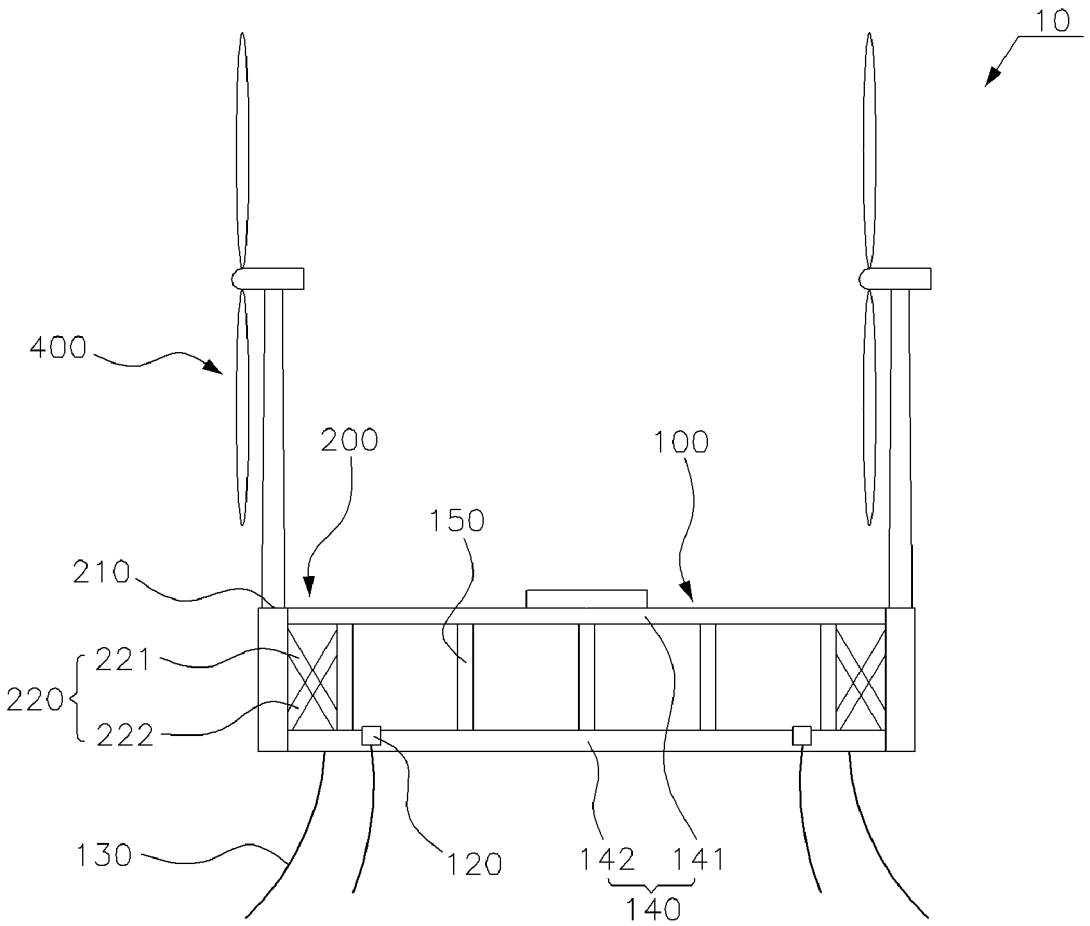
FIG. 9 is a front view of a platform for a floating type offshore structure according to still another exemplary embodiment of the present invention.

FIG. 7 is a front view of a platform for a floating type offshore structure according to an exemplary embodiment of the present invention, FIG. 8 is a front view of a platform for a floating type offshore structure according to another exemplary embodiment of the present invention, and FIG. 9 is a front view of a platform for a floating type offshore structure according to still another exemplary embodiment of the present invention.

The platform 10 for a floating type offshore structure according to the present invention may include a main body 100 and a protrusion member connecting unit 200 and the main body 100 includes a horizontal connecting unit 140 having an arrangement structure in which a plurality of pontoons is coupled in a horizontal direction and a vertical connecting unit 150 configured by columns having a shape of a vertical frame.

Specifically, the horizontal connecting unit 140 is disposed such that an upper horizontal connecting unit 141 and a lower horizontal connecting unit 142 are spaced apart from each other with a predetermined interval to be parallel and the vertical connecting unit 150 is disposed between the upper horizontal connecting unit 141 and the lower horizontal connecting unit 142 to be perpendicular thereto to support the horizontal connecting units 140.

Here, "horizontal" means a width direction in FIGS. 7 to 9 and "vertical" means a length direction in FIGS. 7 to 9.

Referring to FIGS. 7 to 9, the platform 10 for a floating type offshore structure according to the present invention may further include a protrusion member reinforcing unit 220 which connects a side pontoon 110 of the main body 100 and the protrusion member 210 and extends from the vertical connecting unit 150 of the main body 100 to be inclined.

That is, since the protrusion member 210 is formed at an end of the protrusion member connecting unit 200 in the platform 10 for a floating type offshore structure according to the present invention, the load may be concentrated on the protrusion member 210. Therefore, the protrusion member reinforcing unit 220 may be added to disperse the load.

Referring to FIG. 7, the protrusion member reinforcing unit 220 according to an exemplary embodiment of the present invention is downwardly inclined from the upper portion of the vertical connecting unit 150 of the main body 100 and disperses the load which is applied to the protrusion member 210.

Referring to FIG. 8, the protrusion member reinforcing unit 220 according to another exemplary embodiment of the present invention is upwardly inclined from the lower portion of the vertical connecting unit 150 of the main body 100 and disperses the load which is applied to the protrusion member 210.

Referring to FIG. 9, the protrusion member reinforcing unit 220 according to still another exemplary embodiment of the present invention includes a first protrusion member reinforcing unit 221 which is downwardly inclined from the upper portion of the vertical connecting unit 150 of the main body 100 and a second protrusion member reinforcing unit 222 which is upwardly inclined from the lower portion of the vertical connecting unit 150 of the main body 100 and more efficiently disperses the load applied to the protrusion member 210.

Although a specific exemplary embodiment of the present invention has been described, it should be understood that various modifications may be made therein without departing from the scope of the present invention. Therefore, the scope of the present invention should not be limited to the described embodiment, but should be determined by the claims to be described below and equivalents thereof.

As described above, although the present invention has been described by limited embodiments and drawings, the present invention is not limited to the embodiments, and it will be apparent to those skilled in the art to which the present invention pertains that various modifications and variations may be made from the description. Therefore, the spirit of the present invention needs to be interpreted by the appended claims and all equivalent modifications are included within the spirit of the present invention.

The invention claimed is:

1. A platform for a floating type offshore structure comprising:

a main body which is installed on the sea and has an arrangement structure in which a plurality of pontoons are combined to form a plurality of polygonal shapes;

a protrusion member on which a tower is installed; and a protrusion member connecting unit which extends from each corner of the main body and connects the protrusion member to the main body, wherein the protrusion member protrudes outwardly from the main body and is located at an end of the protrusion member connecting unit, wherein the protrusion member connecting unit is formed to outwardly protrude with respect to a center of the main body and an extending length direction of the protrusion member connecting unit intersects the center of the main body, wherein mooring line fastening units connecting a mooring line are installed at a side pontoon of the main body, wherein the mooring line fastening units are installed on both sides of the corner, and wherein the mooring line fastening units are disposed to be symmetrical to each other with respect to the extending length direction of the protrusion member connecting unit.

2. The platform for the floating type offshore structure of claim 1, wherein the tower is a wind tower for wind power generation.

3. The platform for the floating type offshore structure of claim 1, wherein the main body includes an upper horizontal connecting unit and a lower horizontal connecting unit which have an arrangement structure in which the plurality of pontoons are coupled in a horizontal direction and spaced apart from each other to be parallel; and a vertical connecting unit which is disposed between the upper horizontal connecting unit and the lower horizontal connecting unit to be perpendicular thereto.

4. The platform for the floating type offshore structure of claim 3, further comprising:

a protrusion member reinforcing unit which connects the side pontoon of the main body and the protrusion member and extends from the vertical connecting unit of the main body to be inclined.

5. The platform for the floating type offshore structure of claim 4, wherein the protrusion member reinforcing unit is formed to be downwardly inclined from an upper portion of the vertical connecting unit of the main body.

6. The platform for the floating type offshore structure of claim 4, wherein the protrusion member reinforcing unit is formed to be upwardly inclined from a lower portion of the vertical connecting unit of the main body.

7. The platform for the floating type offshore structure of claim 4, wherein the protrusion member reinforcing unit includes a first protrusion member reinforcing unit which is formed to be downwardly inclined from the upper portion of the vertical connecting unit of the main body; and a second protrusion member reinforcing unit which is formed to be upwardly inclined from the lower portion of the vertical connecting unit of the main body.

8. A semi-submersible offshore structure comprising a platform for a floating type offshore structure having a protrusion member comprising:

a main body which is installed on the sea and has an arrangement structure in which a plurality of pontoons is combined to form a plurality of polygonal shapes;

a protrusion member on which a tower is installed; and a protrusion member connecting unit which extends from each corner of the main body and connects the protrusion member to the main body, wherein the protrusion member protrudes outwardly from the main body and is located at an end of the protrusion member connecting unit, wherein the protrusion member connecting unit is formed to outwardly protrude with respect to a center of the main body and an extending length direction of the protrusion member connecting unit intersects the center of the main body, wherein a mooring line fastening unit for connecting a mooring line is installed at a side pontoon of the main body, wherein the mooring line fastening units are installed on both sides of the corner, and wherein the mooring line fastening units are disposed to be symmetrical to each other with respect to the extending length direction of the protrusion member connecting unit.

9. The semi-submersible offshore structure of claim 8, wherein the tower is a wind tower for wind power generation.

10. The semi-submersible offshore structure of claim 8 comprising the platform for a floating type offshore structure having the protrusion member wherein the main body includes an upper horizontal connecting unit and a lower horizontal connecting unit which have an arrangement structure in which the plurality of pontoons is coupled in a horizontal direction and spaced apart from each other to be parallel; and a vertical connecting unit which is disposed between the upper horizontal connecting unit and the lower horizontal connecting unit to be perpendicular thereto.

11. The semi-submersible offshore structure of claim 8 further comprising:

a protrusion member reinforcing unit which connects the side pontoon of the main body and the protrusion member and extends from the vertical connecting unit of the main body to be inclined.

12. The platform for the semi-submersible offshore structure of claim 8, wherein the protrusion member reinforcing unit is formed to be downwardly inclined from an upper portion of the vertical connecting unit of the main body.

13. The platform for the semi-submersible offshore structure of claim 8, wherein the protrusion member reinforcing unit is formed to be upwardly inclined from a lower portion of the vertical connecting unit of the main body.

14. The platform for the semi-submersible offshore structure of claim 8, wherein the protrusion member reinforcing unit includes a first protrusion member reinforcing unit which is formed to be downwardly inclined from the upper portion of the vertical connecting unit of the main body; and a second protrusion member reinforcing unit which is formed to be upwardly inclined from the lower portion of the vertical connecting unit of the main body.

15. A platform for a floating type offshore structure, comprising:

a main body which is installed on the sea and has an arrangement structure in which a plurality of pontoons is combined to form a plurality of polygonal shapes;

a protrusion member on which a tower is installed;

a protrusion member connecting unit which extends from each corner of the main body and connects the protrusion member to the main body, wherein the protrusion member protrudes outwardly from the main body and is located at an end of the protrusion member connecting unit, and wherein the main body includes an upper horizontal connecting unit and a lower horizontal connecting unit which have an arrangement structure in which the plurality of pontoons is coupled in a horizontal direction and spaced apart from each other to be parallel, and a vertical connecting unit which is disposed between the upper horizontal connecting unit and the lower horizontal connecting unit to be perpendicular thereto; and a protrusion member reinforcing unit which connects a side pontoon of the main body and the protrusion member and extends from the vertical connecting unit of the main body to be inclined, wherein the protrusion member reinforcing unit is formed to be downwardly inclined from an upper portion of the vertical connecting unit of the main body.

16. The platform for the floating type offshore structure of claim 15, wherein the protrusion member reinforcing unit is formed to be upwardly inclined from a lower portion of the vertical connecting unit of the main body.

17. The platform for the floating type offshore structure of claim 15, wherein the protrusion member reinforcing unit includes a first protrusion member reinforcing unit which is formed to be downwardly inclined from the upper portion of the vertical connecting unit of the main body; and a second protrusion member reinforcing unit which is formed to be upwardly inclined from the lower portion of the vertical connecting unit of the main body.

18. The platform for the floating type offshore structure of claim 15, wherein a mooring line fastening unit for connecting a mooring line is installed at the side pontoon of the main body, wherein the mooring line fastening units are installed on both sides of the corner, and wherein the mooring line fastening units are disposed to be symmetrical to each other with respect to the extending length direction of the protrusion member connecting unit.

* * * * *